United States Patent [19]

Anderson et al.

[11] 3,945,861

[45] Mar. 23, 1976

[54] HIGH STRENGTH AUTOMOBILE BUMPER ALLOY

[75] Inventors: William A. Anderson, Pittsburgh; Ralph W. Rogers, Jr.; William D. Vernam, both of New Kensington, all of Pa.

[73] Assignee: Aluminum Company of America, Pittsburgh, Pa.

[22] Filed: Apr. 21, 1975

[21] Appl. No.: 570,267

[52] U.S. Cl. ..... 148/12.7

[51] Int. Cl.[2] ..... C22F 1/04

[58] Field of Search ..... 148/12.7, 11.5 A; 75/141, 75/142

[56] References Cited

UNITED STATES PATENTS

| | | | |
|---|---|---|---|
| 2,865,796 | 12/1958 | Rosenkranz | 148/12.7 |
| 3,212,941 | 10/1965 | O'Brien | 148/12.7 |
| 3,762,916 | 10/1973 | Kirman | 148/12.7 |
| 3,850,763 | 11/1974 | Zinnbauer et al. | 148/12.7 |

*Primary Examiner*—W. Stallard

*Attorney, Agent, or Firm*—Carl R. Lippert; Andrew Alexander

[57] ABSTRACT

An improved automotive bumper or bumper back-up bar is provided in an aluminum alloy containing selected amounts of zinc and magnesium with a small amount of zirconium and copper, with small amounts of chromium and manganese being optional but preferred. Copper is included to enhance strength. The alloy can contain 5.5–9% Zn, 0.8–2% Mg, 0.11–0.25% Cu, 0.05–0.2% Zr, and preferably 0.05–0.35% Mn or 0.05–0.25% Cr, or both. The alloy products contemplated include shaped sheet and extrusion bumper products. The improved method contemplates homogenization at a controlled temperature and control of subsequent thermal exposure to, in cooperation with the homogenization, assure good performance from the standpoint of both strength and resistance to stress corrosion cracking.

13 Claims, 3 Drawing Figures

HIGH STRENGTH AUTOMOBILE BUMPER ALLOY

BACKGROUND OF THE INVENTION

There is increasingly more activity in the field of aluminum bumpers for automobiles and other vehicles. The advantages of aluminum are immediately obvious in that it offers relatively high strength at a substantial weight savings, the weight savings being important both from the standpoint of performance and ecology considerations not to mention substantial fuel savings.

An aluminum product to serve properly as a bumper needs to possess substantial strength, resistance to denting and resistance to stress corrosion cracking. Additionally, it should lend itself to relatively easy fabricating procedures. The significance of the first and second is immediately obvious and the significance of the third revolves around the inevitable exposure of the bumper to salt or other corrosive media which can cooperate with mechanical loads to initiate cracks in an aluminum member, which cracks can later lead to failures. For instance, in employing a bumper jack to raise an automobile as in replacing a tire, a stress corrosion cracking failure can lead to disastrous results and is therefore considered a highly critical aspect in selecting a bumper product. With respect to the fabricating procedures, the aluminum alloy should not require extremely high press loads in the case of extrusion, or have unusually slow extrusion rates in order to be commercially feasible. It would also be useful if the material could be chemically brightened so as to alleviate the need for chrome plating, although this is a less significant aspect since chrome plating is neither excessively expensive nor does it introduce other problems which are difficult to cope with. The major problem to date has been to develop an alloy and fabrication sequence which will produce a bumper having relatively high strength, preferably 56,000 psi tensile yield strength or higher and the requisite resistance to stress corrosion cracking. Some materials satisfy either but not both of these requirements and some even satisfy both, but at substantial expense or difficulty in fabrication so as to either create an undesirable rejection rate problem or other economically undesirable aspects.

STATEMENT OF THE INVENTION

The present invention contemplates use of an aluminum alloy containing zinc, magnesium, copper, zirconium, and also including manganese and chromium and controlled thermal mechanical practices in producing the ultimate bumper product. In its broadest aspect, the invention contemplates an alloy containing 5.5–9% Zn, 0.8–2% Mg, 0.11–0.25% Cu and 0.05–0.2% Zr with optional additions of 0.05–0.35% Mn or 0.05–0.3% Cr, or both, being preferred. The ingot or other starting material of the described alloy is homogenized at a temperature of 800°–900°F and then fabricated into a sheet or plate product or an extruded product suitable for shaping or bending into a bumper which is then solution heat treated, quenched and aged. The fabrication sequence may include annealing treatments which should be performed at controlled temperatures of below 800°F since such in conjunction with the controlled homogenization assures an unrecrystallized grain structure in the ultimate product which provides for improved resistance to stress corrosion cracking.

DETAILED DESCRIPTION

In the detailed description which now proceeds, reference is made to the following drawings in which.

In addition to the alloy limits described above, a preferred minimum for Zn is about 6% and a preferred maximum is about 8%. For Mg a preferred minimum is about 1.0% and a preferred maximum is about 1.8%. Zr is preferably 0.08–0.15%. Copper should be preferably controlled within 0.13–0.20%. Manganese is desirably present in amounts of about 0.05–0.35% and chromium in amounts of 0.05–0.2%. Preferably the alloy contains both Mn and Cr. One preferred composition contemplates about 6.4–7.8% Zn, 1–1.6% Mg, 0.13–0.20% Cu, 0.05–0.25% Cr, 0.08–0.15% Zr and 0.05–0.30% Mn. In this composition it is further preferred that the Zn:Mg ratio be about 7:1.3 as this corresponds stoichiometrically to the ratio of these elements in one of the principal hardening phases in this alloy, $MgZn_2$.

Impurities are controlled such that the following maxima apply: 0.2% Si, 0.4% Fe and 0.06% Ti. Other impurities are preferably limited to about 0.1% each and the combination of other impurities should not exceed 0.5% total. However, within these limits it is preferred that the grand total of all impurities not exceed 0.75%. Where bright finishing characteristics are desired, further limits on impurities and other elements need be imposed. Thus where bright finishing is of importance, iron and silicon are respectively limited to 0.15 and 0.1% each and manganese and chromium which are otherwise desirable are now limited to 0.05% each.

Figure 1:
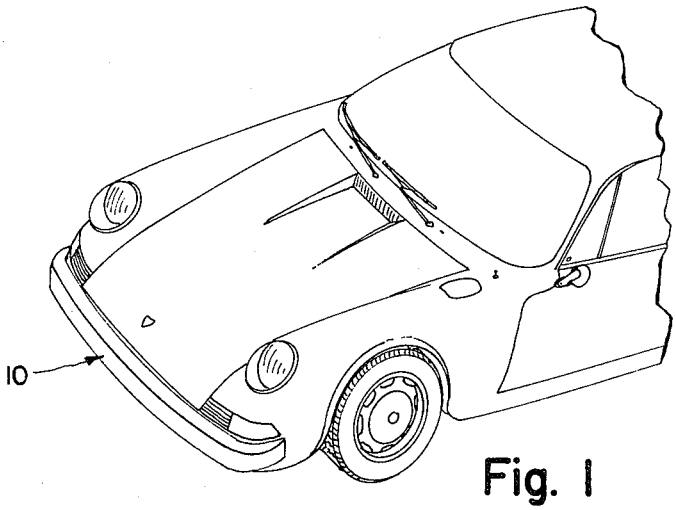
FIG. 1 is an isometric view depicting a typical automotive bumper.
Figure 2:
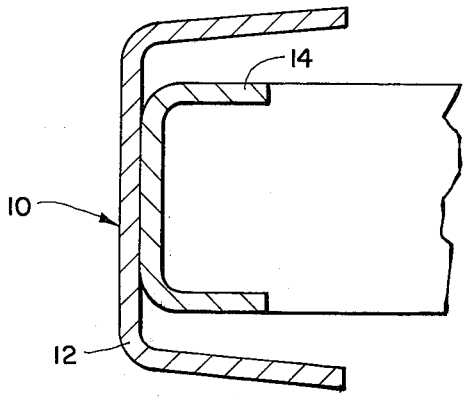
FIG. 2 is an elevation view in cross section of an automotive bumper and back-up bar.
Figure 3:
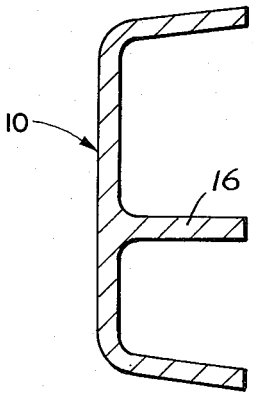
FIG. 3 is an elevation view in cross section of an extruded automotive bumper.

As mentioned earlier, automotive bumpers can be fashioned from box or channel-like shapes although other shapes may also be usefully employed in making bumpers and bumper back-up members in accordance herewith. Referring to the figures there is shown in FIG. 1 a typical automotive bumper 10 and it can be seen that the general shape of the bumper is of a channel section curved through an arc along its length, the curvature becoming sharper at each end of its length so as to wrap around the fender area slightly as is the known custom in fashioning automotive bumpers. Referring now to FIG. 2, there is shown an elevation in cross section of a bumper including face member 12 which is of a generally channel-like shape but configured to satisfy the aesthetic desires of the designer, and back-up member 14 is depicted as a channel-like member although it could also be a more rectangular box-like member, its purpose being to provide beam strength across the front of the vehicle and back-up support for the bumper face member 12. FIG. 3 depicts an extruded channel-like member provided with an integral reinforcing member 16. These general aspects of bumper design are well recognized in the art and need little elaboration here, the views being presented primarily for illustration in this description.

An important aspect of the composition is the amount of copper present. Copper is required to provide the requisite strength required to assure continued use of the product as a bumper without fear of failure such as by stress corrosion cracking. It should be noted that the concentration of copper is to be carefully controlled within the limits indicated. If the concentration of copper decreases substantially below the lower limit, the strength of the product is decreased and consequently the margin of safety inherent during the useful life may be reduced. Conversely, if the amount of copper is increased above the upper limit, other considerations may arise in the area of diminished weldability and decreased ease of fabrication both as to the basic sheet or extrusion working stock and as to the bumper shaped therefrom. It has been found that controlling copper within the herein prescribed limits provides significant strength over a like material without copper but without significant adverse side effects. An equal strength achievable by increasing the content of other elements, i.e., zinc, can adversely affect the other properties. For example, the amount of zinc required to increase the strength of the alloy by the same amount as that resulting from the copper added would have to by many times the amount of copper. As the zinc is increased in the amount required for strength, the stress corrosion cracking resistance can decrease, seriously lowering the integrity of the alloy over its useful life. Thus, it will be understood that to develop an alloy with excellent strength, ease of weldability and workability, and high resistance to stress corrosion cracking requires delicate control over the contents of the alloy, and procedural steps leading to the final product. Thus, it can be appreciated that it is quite difficult to balance all the constituents in an alloy product so as to provide a product having all of the above desirable characteristics and which avoids undesirable features.

In addition to the copper being important from the strength increases gained, it is also important because its presence lowers the electrode potential of the alloy. The copper can reduce the electrode potential of the alloy 40 or 50 millivolts. This decrease in electrode potential reduces the likelihood of galvanic corrosion when the alloy product is coupled to a vehicle body.

Another benefit of the copper is that it reduces the extent of exfoliation corrosion.

Not only is it important to have copper in the controlled amount as hereinbefore described, but the alloy should be prepared according to specific method steps in order to provide the desirable characteristics. That is, the alloy described herein may be suitably provided as an ingot or billet for fabrication into a suitable wrought product by any of the techniques currently employed in the art with continuous casting being preferred. The continuous cast ingot may be either rectangular or circular in cross section and may be preliminarily shaped or worked to provide suitable stock for subsequent working operations. At some stage prior to the principal working operations, the alloy stock is subjected to homogenization temperatures of between 800° and 900°F for an extended period of time of at least 4 hours and preferably 10 hours or more. A time of 16 hours has been found to be quite suitable. The time is selected to provide a homogeneous distribution of the primary elements throughout the alloy metal and to properly distribute constituent phases containing Mn, Cr and Zr in particles whose size and distribution effectively inhibit recrystallization tendencies of the final product during thermal treatments. This homogenization treatment in conjunction with controls on subsequent thermal treatments cooperate to assure an essentially unrecrystallized grain structure even after the product is annealed or solution heat treated and it is this unrecrystallized grain structure which contributes so significantly to resistance to stress corrosion cracking.

The homogenized alloy stock or body is fabricated by rolling, extruding or other procedures to produce stock suitable for shaping into the final bumper or back-up piece configuration. In the case of rolling, the stock is hot rolled to product a sheet-type product of typically about one-eigth to one-fourth inch or above or below this level by some amount. For instance, a hot rolled product might be about 0.150 inch in thickness. If a thinner sheet is desired, cold rolling is typically employed and the sheet product contemplated can be rolled down to thicknesses as little as 0.065 inch and even less although obviously a bumper member requires some significant thickness such that a typical sheet thickness for a bumper would be about 0.15 inch. For a channel or box member shaped from sheet to provide a back-up bar, the thickness should be about 0.2 inch. However, thickness may vary with size of the vehicle. The sheet product is then annealed at a temperature below 800°F and then formed to its final section shape. For a bumper face member, the shape can be that depicted in FIG. 2 for face member 12 and it is obvious that this shape can vary substantially from a rounded channel or even an ogive configuration through any of the shapes commonly employed for this purpose. In the case of a back-up bar, the shapes are usually much simpler and are typically channel shaped although this too is subject to variation. After the primary cross sectional shape is achieved, the bumper member is typically bent in an arc or other shape to conform to the configuration of its sweep across the front of its vehicle and at least in the case of the face member 12 the end portions are bent relatively sharply to provide the wraparound feature so common in today's automotive designs.

In the case of an extrusion, the alloy stock after homogenization is extruded typically at a reduction of about 25 to one at a temperature of 800° to 900°F. The low extrusion temperature provides the alloy with greater resistance to stress corrosion cracking. The extrusion temperature is kept relatively low to keep the alloy in its unrecrystallized form to provide the excellent resistance to stress corrosion cracking even though common practice is to extrude at a higher temperature for ease of extrudability. It should be remembered that one reason for very closely controlling the copper content to a maximum of 0.25% is to provide ease of extrusion. Thus, it will now be appreciated that a combination of factors is to be observed in order to provide the unique characteristics of this aluminum bumper product.

The extrusion is typically to the final cross sectional shape and thickness such that the only further working to be done is to bend the piece along its length and to the arc or other shape which conforms to the configuration across the front of the vehicle. This bending can be accomplished by bending the piece while hot, typically at temperatures of 600°–750°F or the workpiece can be annealed and then bent while cold. It is noteworthy in this respect that the improvement enables either hot or cold bending of the beam or section, and this is in itself an advantage which enables the ready implementation of improved bumpers into various plant operations.

It is important that any annealing be carried out at temperatures which do not exceed 800°F and preferably do not exceed 750°F since temperatures above 800°F can deteriorate the benefits of the controlled homogenization treatment.

For instance, annealing at temperatures of 900°–950°F may produce recrystallization of the grain structure notwithstanding the benefits of the improved homogenization. It is worth noting that temperatures of homogenization higher than that specified above could permit recrystallization to occur at lower temperatures and thus it would become difficult to anneal the workpiece without encountering recrystallization.

After shaping, the product is solution heat treated, quenched and artificially aged. The solution heat treatment is typically at a temperature of 700°–750°F and arange of 700°–850°F is contemplated. The time at these temperatures is preferably minimized to avoid recrystallization; a preferred time range is about 15 minutes to about 1 hour.

After solution heat treating, the piece is quenched at a relatively slow rate. That is, it is preferably not quenched by immersion in water which produces a typical quench rate of 2,000°F per second, but is quenched in air or other media typically 100°F per second or preferably less. For instance, quenching in air moved by fans can produce a quench rate of about 5° or 10°F per second depending on the particular conditions involved, and this is quite satisfactory in practicing the invention. The slow quench rate enhances resistance to stress corrosion cracking and in view of the low quench sensitivity of the alloy described, the strength of the bumper product is not impaired substantially or the shape distorted by the slow quench rate. After quenching, the bumper piece can be artificially aged which can be suitably accomplished in two stages, the first featuring a temperature in the range of 175°–250°F and the second featuring a higher temperature than the first ranging typically from about 250° to about 320°F. Times vary significantly with temperature in each step and a time in the first step of about 3 to 8 hours varying generally inversely with temperature in the stated range is suitable, and a time of 3 to 8 hours varying inversely with the temperature stated for the second step is suitable. One suitable practice contemplates 3 hours at 200°F followed by 8 hours at 275°F and another practice contemplates 3 hours each at 250° and 300°F temperatures. An isothermal or single-stage artificial aging treatment of 12–16 hours at 250°–300°F can also be employed.

As an alternative to artificial aging, the bumper can achieve the required strength by a natural aging process. That is, the bumper will achieve the required strength after a period typically of 1 to 2 months at room temperature.

Reference has been made hereinabove to aluminum alloy 7005 whose resistance to stress corrosion cracking is well established. The present alloy product made by fabricating procedures mentioned, by comparison, can provide even better resistance to stress corrosion cracking. The present alloy product has a tensile strength of the order of 10 ksi greater than the aforementioned 7005 aluminum alloy. Thus, by this feature alone, the present alloy product typically provides less susceptibility to stress corrosion cracking. That is, a given stress load will be a smaller percentage of the total yield strength. Also because of its greater tendency to resist recrystallization, this alloy product is less susceptible to stress corrosion cracking than 7005. Furthermore, this alloy product has better dent resistance than 7005, thus providing added resistance to localized residual stresses and therefore stress corrosion cracking.

Examples of alloys and fabrication sequences follow.

EXAMPLE I

Alloy members consisting of the above-described preferred alloys containing 6.5–7.75% Zn, 1–1.7% Mg, 0.13–0.23% Cu, 0.05–0.2% Zr, 0.05–0.35% Mn and 0.05–0.25% Cr with maximum of about 0.2% Si, 0.4% Fe and 0.06% Ti were produced by continuous casting into ingot suitable for both rolling into sheet products and for providing cylindrical extrusion billet. In each case, the alloy stock was homogenized at a temperature between 800°–900°F. Some of the billet was continuously hot rolled at temperatures of 800°F into a sheet product about 0.160 inch in thickness and then further rolled to produce a sheet product 0.100 inch in thickness. The sheet product was then annealed at temperatures below 800°F with a temperature of 650°F being typical. The sheet was fabricated into bumper back-up members which include box beams having sides of typically 3 inches and channels having a web of about 5 inches and flanges about 3 inches wide. Also, some of the sheet was shaped into face plate beams of curved channel cross section. All of the shaping here was done at room temperature.

Other alloy stock in the shape of cylindrical billet was extruded at temperatures of 850°F and then annealed at a temperature of 650°F and subsequently bent at room temperature into final configuration. The extrusions coming off the press were generally ribbed channel shapes such that the final beam section was achieved in extrusion and the only subsequent work would be bending along the length of the extrusion. Sections taken from the bumper face members and back-up bar portions exhibited the following typical tensile properties after final solution heat treatment and artificial aging:

| | Tensile Strength | Yield Strength | Elong. in 2" | Rockwell hardness |
|---|---|---|---|---|
| Sheet | 60 ksi | 55 ksi | 13 | B75 |
| Extrusions | 68 ksi | 62 ksi | 14 | B80 |

In an accelerated stress corrosion test (total immersion in boiling 6% NaCl solution), the specimens in the final solution heat treated and aged conditions, even after being deformed locally beyond the yield strength and relaxed, all exhibited survival times of 7 days which is considered an indication of satisfactory resistance to stress corrosion cracking.

EXAMPLE II

Using the same type of alloy described above but employing a homogenization temperature of 1050°F and fabricating bumper members in substantially the same way as described in Example I, tensile specimens removed compared favorably with those discussed in Example I. However, in the stress corrosion cracking tests the times to failure were as little as 1 hour in a locally deformed area which is considered an indication of low resistance to stress corrosion cracking.

EXAMPLE III

Sheet produced with recommended homogenization treatment and cold rolled to final gauge showed the following stress corrosion susceptibility according to annealing temperature after being locally deformed in the final solution heat treated and artificially aged temper:

| | Percent Cold Work | Annealing Treatment | Stress Corrosion Failures |
|---|---|---|---|
| 1 | 71 | 2 hrs./800°F | None in 7 days exp. |
| 2 | 71 | 2 hrs./875°F | Failed in 47 hours |
| 3 | 62 | 2 hrs./950°F | Failed in 7 hours |

EXAMPLE IV

To further illustrate the significance of the improvement, another alloy candidate for bumpers containing 4.4% Zn, 1.1% Mg and 0.27% Cu was fabricated much the same way as delineated in Example I into automotive bumper members. Tensile properties were only 51 ksi tensile strength, 46 ksi yield strength and 13.5% elongation for extrusions after solution heat treatment and artificial aging. Locally deformed specimens developed stress corrosion cracks after 24–48 hours exposure to the boiling 6% NaCl solution accelerated test which indicates susceptibility to this type of corrosion.

EXAMPLE V

Another alloy within the broad ranges contemplated by the invention and containing 7.0% Zn, 0.8% Mg, 0.2% Cu and 0.13% Zr, with impurities such as Fe and Si kept to a relatively low level, was fabricated into bumper members similar to the extrusions described in Example I. The outer bumper face was mechanically buffed and then chemically brightened employing a phosphoric-nitric acid mixture. After this, the bumper was anodized in a sulfuric acid electrolyte to produce a clear, tough, integrally formed oxide coating. The resulting bumper exhibited a high level of brightness or brilliance, the performance of which is at least partially assured by the anodically formed oxide coating.

EXAMPLE VI

Bumper face members produced according to Example I were chromium plated electrolytically employing a commercial type chrome plating bath and these bumpers exhibited the high level of brilliance or brightness characteristic of chromium plating, and it is to be noted that the brightness is achieved without the critical controls on impurities required for chemical brightening in the preceding example, and thus one embodiment of the invention contemplates a chromium plated bumper of the type here described.

While the invention has been described in terms of preferred embodiments, the claims appended hereto are intended to encompass all embodiments which fall within the spirit of the invention.

Having thus described our invention and certain embodiments thereof, we claim:

1. In the production of an improved automotive bumper, the steps comprising 1. providing a body of aluminum alloy consisting essentially of 5.5–9% Zn, 0.8–2% Mg, 0.11–0.25% Cu, 0.05–0.2% Zr, balance essentially aluminum and incidental elements and impurities;

2. homogenizing said body at a temperature of 800°–900°F;
3. fabricating said body into a bumper section by operations which include hot or warm reductions in thickness and thereafter solution heat treating, quenching and artificially aging the resulting bumper product.

2. In the production of an improved bumper according to claim 1 wherein the alloy contains one of the elements selected from the group consisting of manganese from 0.05–0.35% and chromium from 0.05–0.30%.

3. In the production of an improved bumper according to claim 1 wherein the alloy contains 0.05–0.35% Mn and 0.05–0.30% chromium.

4. The method according to claim 1 wherein said fabrication operations in said step (2) included hot rolling to produce a sheet product, annealing at temperatures not over 800°F and shaping said sheet into said beam section.

5. The method according to claim 1 wherein in step (3) said working operations include extruding to produce a wrought product having a beam section.

6. The method according to claim 5 wherein said extruded beam section is bent along its length at an elevated temperature of at least 650°F but not to exceed 750°F.

7. The method according to claim 5 wherein said extruded beam section is annealed at a temperature not to exceed 800°F and thereafter bent along its length at room temperature.

8. The method according to claim 1 in which the bumper product is solution heat treated at a temperature of between 700°–800°F and is quenched relatively slowly at a rate not to exceed 100°F per second from said solution heat treatment temperature to a temperature not above 700°F.

9. The method according to claim 8 in which said quenched bumper product is artificially aged either isothermally 12–16 hrs./275°F or by step ages of 3–8 hours at 175°–250°F plus 3–8 hours at 275°–320°F.

10. In the production of an improved aluminum bumper beam member wherein an aluminum alloy workpiece is shaped into a bumper beam section by operations which include metal working at temperatures of 750°F or less or at room temperature after annealing at 600°–800°F and wherein said bumper beam section is thereafter solution heat treated and artificially aged, the improvement wherein said aluminum is provided as an alloy consisting essentially of 5.5–9% Zn, 0.8–2% Mg, 0.11–0.25% Cu, 0.05–0.2% Zr, balance essentially aluminum, and said alloy body is homogenized at a temperature of 800°–900°F.

11. In the production of an improved aluminum bumper beam member wherein an aluminum alloy workpiece is shaped into a bumper which is solution heated, quenched and artificially aged, the improvement wherein said aluminum alloy is provided as an alloy consisting essentially of 5.5–9% Zn, 0.8–2% Mg, 0.11–0.25% Cu, 0.08–0.15% Zr, 0.05–0.35% Mn, 0.05–0.30% Cr, balance essentially aluminum and incidental elements and impurities and said body is homogenized at a temperature of 800°–900°F and further wherein portions of said shaping occur at elevated temperatures of 600°–750°F or at room temperature following annealing at 600°–800°F.

12. In the production of an improved aluminum bumper beam member according to claim 10 wherein said alloy is provided as a rolled sheet product which is shaped into said bumper.

13. In the production of an improved aluminum bumper beam member according to claim 10 wherein said alloy is provided as an extrusion product which is shaped into said bumper.

* * * * *